United States Patent [19]

Watson

[11] 4,235,348

[45] Nov. 25, 1980

[54] DRINKING VESSELS FOR RECLINING POSITION USAGE

[76] Inventor: Lionel E. Watson, P.O. Box 3966, Ft. Pierce, Fla. 33450

[21] Appl. No.: 4,368

[22] Filed: Jan. 18, 1979

[51] Int. Cl.[3] ..... A47G 19/22

[52] U.S. Cl. ..... 220/90.4; 206/427; 220/90.6; 220/94 A; 220/DIG. 5

[58] Field of Search ..... 220/90.2, 90.4, 72, 220/74, 90, 90.6, DIG. 5, 94 A; 222/571, 572, 573, 570, 465, 466, 575, 566; 128/222; 206/45.31, 45.33, 45.34, 427, 434; D7/64, 60, 50; D9/290

[56] References Cited

U.S. PATENT DOCUMENTS

| | | | |
|---|---|---|---|
| D. 27,886 | 11/1897 | Rogers . | |
| D. 29,814 | 12/1898 | Williams . | |
| D. 69,074 | 12/1925 | Goodwin . | |
| D. 90,906 | 10/1933 | Baker, Jr. | D7/50 |
| D. 102,088 | 11/1936 | Mackelfresh | D7/60 X |
| D. 103,167 | 2/1937 | Swainson . | |
| D. 156,671 | 12/1949 | Russel | D7/64 |
| D. 156,803 | 1/1950 | Badash . | |
| D. 160,772 | 11/1950 | Cowan . | |
| D. 163,117 | 5/1951 | Hobbs | D7/64 |
| D. 164,344 | 8/1951 | Wright | D7/64 |
| D. 168,784 | 2/1953 | Del Mas | 220/90.2 X |
| D. 180,587 | 7/1957 | Dube . | |
| D. 181,348 | 11/1957 | Dube . | |
| D. 185,063 | 5/1959 | Clark, Jr. . | |
| D. 186,392 | 10/1959 | Stetson et al. . | |
| D. 219,054 | 10/1970 | Gulotta . | |
| D. 219,164 | 11/1970 | Gropius . | |
| D. 220,845 | 6/1971 | Mascetti, Jr. . | |
| D. 235,182 | 5/1975 | Capron . | |
| D. 235,405 | 6/1975 | Brown et al. | D7/50 |
| 497,940 | 5/1893 | Bacon, Jr. | 220/90.2 |
| 1,500,951 | 7/1924 | McGhee | 222/573 X |
| 1,543,209 | 6/1925 | Fulton | 128/222 |
| 2,124,021 | 7/1938 | Akers | 220/90 |
| 2,271,822 | 2/1942 | Hills | 222/572 |
| 2,483,943 | 10/1949 | Slawik . | |
| 2,521,523 | 9/1950 | Kemper | 220/DIG. 5 |
| 2,566,527 | 9/1951 | Lilly | 222/572 X |
| 2,687,628 | 8/1954 | Cunningham . | |
| 2,764,325 | 9/1956 | Pellandini | 222/570 |
| 3,994,397 | 11/1976 | Fishlove | 206/434 X |

FOREIGN PATENT DOCUMENTS

| | | | |
|---|---|---|---|
| 803645 | 10/1936 | France | 222/572 |
| 70031 | 11/1948 | Norway | 220/90.2 |
| 319485 | 9/1929 | United Kingdom | 222/572 |

*Primary Examiner*—Allan N. Shoap
*Attorney, Agent, or Firm*—James A. Wong

[57] ABSTRACT

Novelly improved drinking vessels of the type adapted for selective preferential or essentially mandatory usage by and while a user is in either a partially or fully reclined position. The vessels may be either of the handled cup-like type, or of the non-handled generally conventional drinking glass type, but which embody an integrally formed open-trough-like spout projecting laterally from one side of the vessels by which liquid is conveyed to a user. The spouts have uniquely and novelly-contoured lip or mouth engageable outward terminal edges and specially curved liquid-spill-resistant side walls of the spout to facilitate improved spill resistant complemental mating with a user's lips. The handled cup-like vessels are provided with the novelly improved spouts in variously disposed 90°, 180°, and 270° positions relative to the handle, thereby facilitating use by both left and right handed users, as well as by an attendant on duty with a potential user for straight ahead auxiliary usage by the user and attendant.

15 Claims, 16 Drawing Figures

FIG. 1.
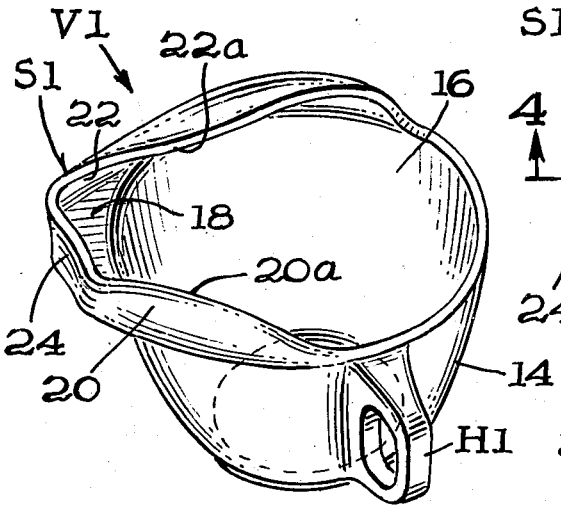
FIG. 2.
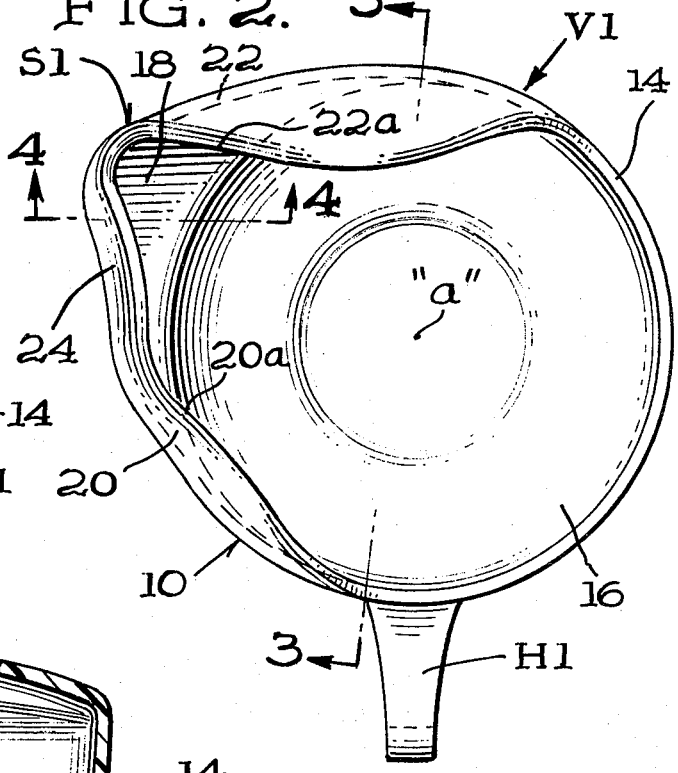
FIG. 3.
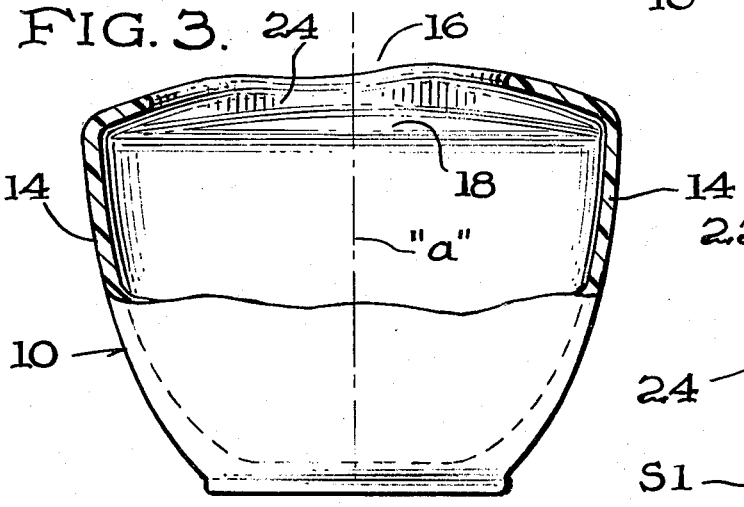
FIG. 4.
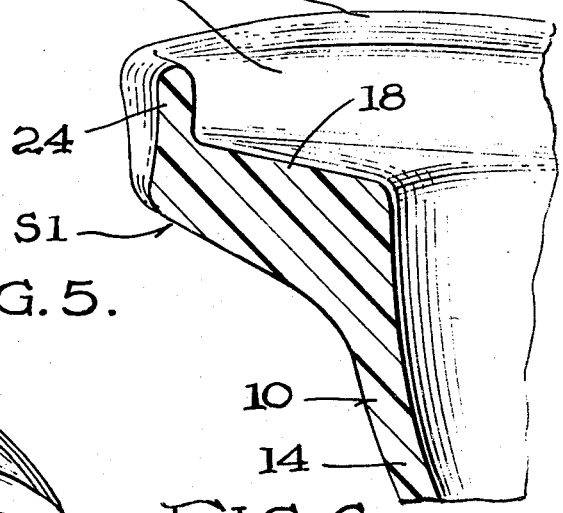
FIG. 5.
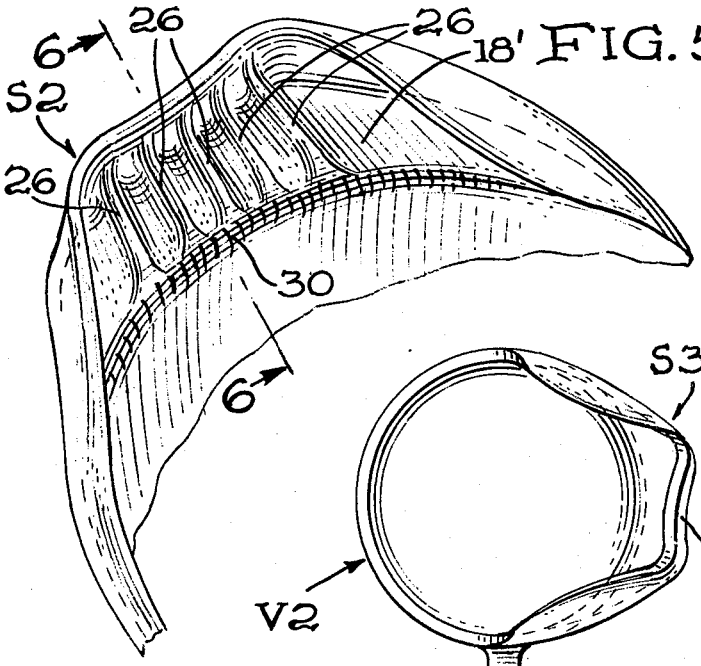
FIG. 6.
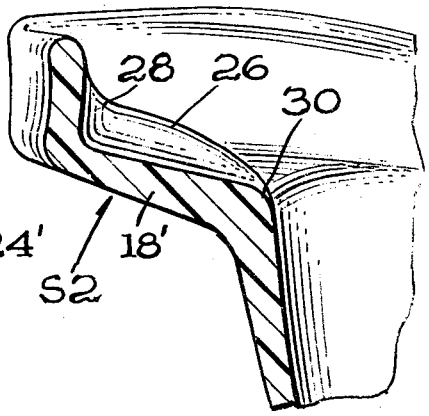
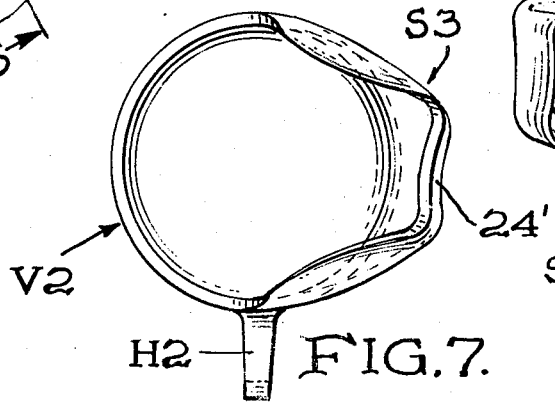
FIG. 7.

FIG. 8.
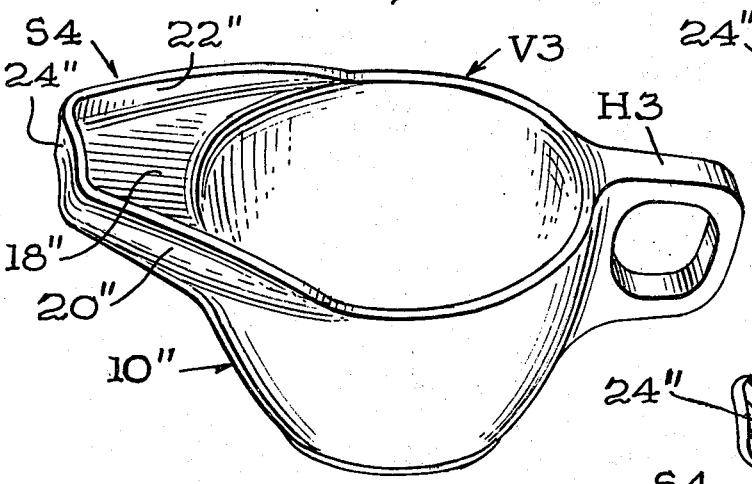
FIG. 12.
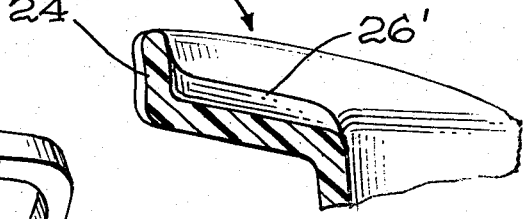
FIG. 10.
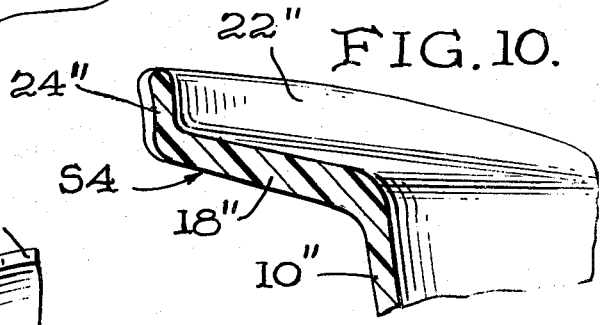
FIG. 9.
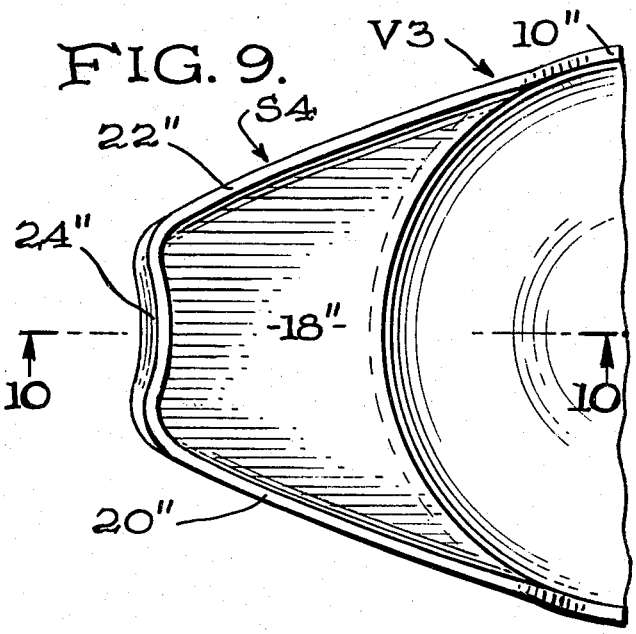
FIG. 15.
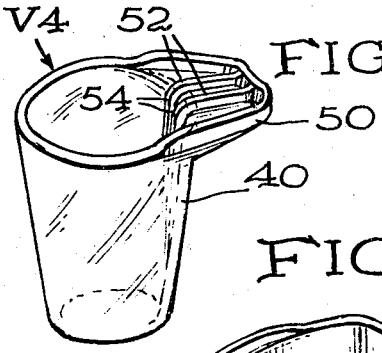
FIG. 16.
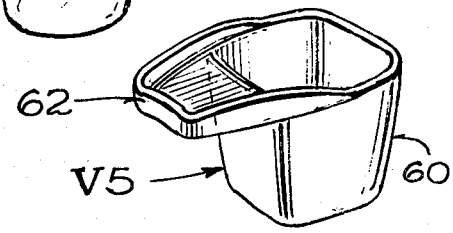
FIG. 14.
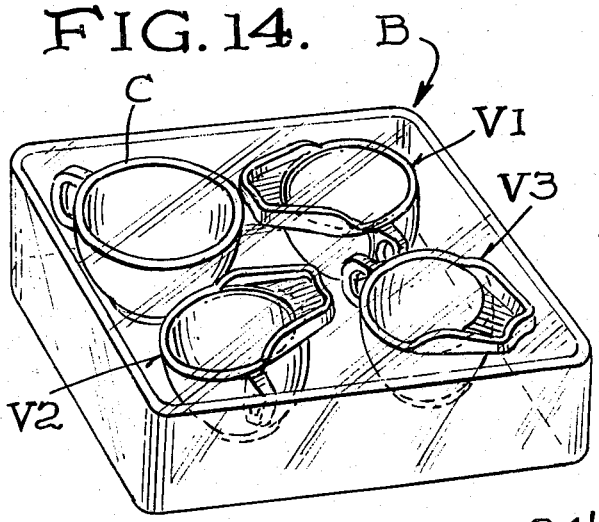
FIG. 11.
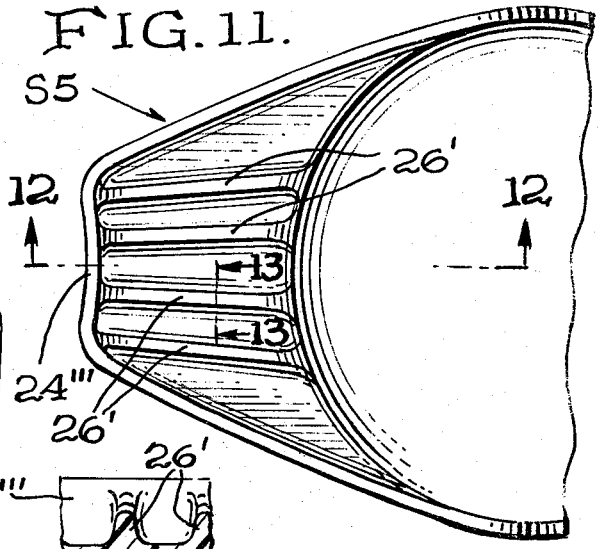
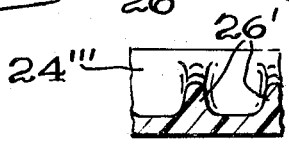
FIG. 13.

DRINKING VESSELS FOR RECLINING POSITION USAGE

This invention relates to certain new and useful improvements in vessels adapted for use as drinking cups and glasses, and more particularly relates to such type vessels for improved spill-resistant use by persons who selectively choose or otherwise are required to drink liquids while laying in bed or otherwise in a reclining position.

A principal object of the invention is to provide such vessels with improved spill-resistant liquid channeling or conveying, prefereably open-troughed spouts, each of which vessel's spout projects laterally from one side of the vessel near its open upper end, and which spouts more specifically are each respectively provided with a uniquely and novelly contoured lip- or mouth-engageable outward terminal edge, and further provided with specially upwardly and oppositely concave opposed side walls, to thereby collectively provide essentially spill-free complemental mating with a user's lips and mouth.

Another object of the invention is to provide vessels of the aforedescribed drinking cup class, each of which cups is provided with a handle in particular pre-selected relation to the improved spout, or vice versa, including relative dispositions of essentailly 90°, 180° and 270°, the former and latter more particularly being adapted for use by left and right handed users.

Yet another object of the invention is to provide novelly-improved vessels of the cup, mug and glass type according to the preceding objectives, which are suitable for everyday usage, and recreational and party usage by children, teens and adults equally alike.

Still another object of the invention is to provide improved vessels according to the preceding objectives with spouts which may vary in the length of projection from the body of the vessel for various preferences and contemplated uses, such as when the liquid is being administered to an invalid user by another person.

A still further object is to provide a packaged plurality of the improved handled cup style vessels, with said plurality including at least one vessel each having the spout and handle relative relationships of essentially 90°, 180°, and 270° respectively.

The means by which the foregoing and other objects and advantages are achieved, and the manner of achievement, will be more readily understood from the following detailed description taken in conjunction with the accompanying illustrative drawings, in which:

FIG. 1 is a perspective view of one of a handled cup-like vessel having an improved liquid directing spout disposed 90° relative to the handle for right-handed usage;

FIG. 2 is a slightly enlarged plan view of the cup vessel of FIG. 1;

FIG. 3 is view partially in elevation and partially in transverse cross-section as seen on line 3—3 of FIG. 2;

FIG. 4 is a further enlarged fragmentary cross-sectional view through the spout portion as seen on line 4—4 of FIG. 2;

FIG. 5 is an enlarged fragmentary perspective view of an improved liquid directing spout of modified form having a plurality of spaced rib members formed therewith;

FIG. 6 is a further enlarged fragmentary cross-sectional detail of the spout and rib formation a seen on line 6—6 of FIG. 5;

FIG. 7 is a top plan view of a modified cup style vessel shown on a smaller scale than the vessel depicted in FIG. 2, and of a style to facilitate left handed usage;

FIG. 8 is a perspective view of another modified form of the handled cup-like vessel adapted for use by drinking from a centered spout aligned diametrically opposite the handle;

FIG. 9 is an enlarged fragmentary plan view of the spout and left half portion of the cup-like vessel shown in FIG. 8;

FIG. 10 is a longitudinal cross-sectional view as seen substantially on line 10—10 of FIG. 9;

FIG. 11 is a fragmentary top plan view of a modified cup-like vessel similar to that depicted in FIGS. 8 and 9;

FIG. 12 is a fragmentary detail cross-sectional view as seen on line 12—12 of FIG. 11;

FIG. 13 is a detailed fragmentary cross-sectional view taken on line 13—13 of FIG. 11;

FIG. 14 is a perspective view of a packaged plurality of the improved vessels adaptable for commercial display and/or exploitation;

FIG. 15 is a perspective view of still a further modification of the improved vessel herein, being of the non-handled, general drinking glass type having a body of generally cylindrical form; and also including modified spill-resistant ribs in the spout; and FIG. 16 is a similar perspective view like that of FIG. 15, wherein the vessel body is of generally rectangular configuration when viewed in horizontal plan and cross-section.

Reference will now be had to the illustrative drawings, wherein like reference characters designate like parts throughout the related drawing figures of the various embodiments. Referring first to the embodiment of FIGS. 1–4, the improved vessel, generally designated V1, comprises a main body 10 of generally hollow form having a closed bottom end 12, a generally uninterrupted peripheral side wall 14 formed about a generally centered vertical axis "a" and terminating in an open upper end 16. A spout designated generally S1 is oriented at about 90° relative to a handle H1 and thus is adapted for right-handed users. The spout S1 is of open trough-like form and is integrally fabricated with the body of the cup vessel. The said spout projects laterally outwardly away from the axis and vessel body at its upper end. The open trough-like character of the spout is defined by a bottom floor portion 18 projecting from an upper part of the body wall 14, and a pair of oppositely spaced side walls 20, 22 upstanding from lateral edges of the floor portion. The floor portion 18 extends outwardly and terminates in an upstanding short outer wall portion 24 which is of slightly outwardly concave configuration to facilitate improved spill-resistent complemental mating with a user's lips. The spout's terminal outer wall portion 24 may also be of concave form in both horizontal and transverse cross-sections thereof, as readily seen in the drawings, to further enhance the complementary mating with a user's lips or mouth. The said upstanding outer wall portion 24 is preferably but not necessarily generally parallel to the center axis "a", and has a smoothly rounded exposed edge surface.

Side walls 20 and 22 of the spout are shown in an oppositely diverging relationship and respectively terminate at upper edges in generally horizontally inwardly curved portions **20*a* and 22*a* respectively, while also extending toward and smoothly terminally blending with upper portions of the peripheral side wall 14 in generally diametrically opposed areas of the body 10**. These areas are also generally aligned with or on an imaginary vertical plane passing through the cup handle and center axis of the vessel.

It is apparent that the upwardly and inturned curved formation of the side portions 20*a* and 22*a* serve to effectively funnel and preclude spillage of liquid during usage of the vessel. It is also contemplated that the spout may be formed with a greater length spout, such as shown in the embodiment of FIGS. 8–11, and with generally more parallel side walls corresponding to 20 and 22 respectively.

Reference will now be made to a modified form of the spout, designated S2, as depicted in FIGS. 5 and 6. Spout S2 is preferably of the same basic general form as described in FIGS. 1–4, but is further provided on its floor 18' with a plurality of spaced-apart upstanding rib members 26. The rib members 26 are utilized to help stabilize and channel the liquid while being dispensed from the vessel via the spout. As shown in FIGS. 5 and 6, the ribs 26 are disposed in essentially parallel or near parallel formation, and each rib is tallest at its forward or outwardmost part 28 where it concavely curves smoothly into the upper part of the outer wall portion 24. The ribs of this form preferably progressively reduce in height along their length until they diminish and terminate at their rearwardmost end in a smoothly convex curve blending with the curved part 30 formed by the junction of the cup's peripheral wall with the floor portion 18'. As will be seen in other embodiments hereof, the ribs may be of essentially uniform, non-reducing height (FIG. 12) and at least part of the ribs may be disposed in slightly converging relation, such as shown in FIG. 11. It is preferable that the tops and the bottom junctures of the ribs be smoothly rounded, not only to avoid potential scratching of the user's lips or mouth, but also to facilitate ease of cleaning.

Proceeding to FIG. 7, the cup style vessel therein is designated generally at V2 and is very much like the previously described embodiment of FIGS. 1–4, except for the opposite orientation of the spout S3 and handle H2, which is designed for left-handed users. A further slight difference as shown is the less angularly disposed outer wall portion 24' of the spout S3.

Reference is next made to the embodiment depicted in FIGS. 8–10, wherein the vessel thereof is designated generally V3. The body 10'' and handle H3 are essentially the same as those correspondingly described in the foregoing embodiments, with only the spout S4 varying from the form and orientation of those previously described relative to the handle H3.

In this latter embodiment, the spout S4 is shown to be of slightly greater length and to be oriented in generally diametrically opposite alignment with the handle H3, and thus is at approximately the 180° position relative thereto. Spout S4 is otherwise broadly of the same construction as that of the previously described spouts, except that as shown the opposite side walls 20'' and 22'' connected with floor portion 18'' are not inwardly turned toward each other. This embodiment is more adapted to be held by a person other than the one drinking from the vessel, who is helping administer the liquid to the person receiving it. It can, however, also be used directly by the user, where desired. The outer wall portion 24'' is otherwise essentially like its counterpart 24 described in the first embodiment.

A variation of the spout S4 is shown in FIGS. 11, 12 and 13, and is designated S5. It is similar to the ribbed spout of the embodiment shown in FIGS. 5 and 6. As shown in FIGS. 11, 12 and 13, the ribs 26' are of more uniform height throughout their length, and slightly coverge toward the outer wall portion 24'', the latter of which is also essentially like its counterpart 24 described hereinabove.

Proceeding to FIG. 14, a plurality of vessels, preferably four, are shown assembled in a prepackaged kit or box B. The plurality of vessels preferably include at least one of each of the vessels V1, V2, and V3, and further one ordinary or unspouted cup C. It is contemplated that these cups may be decorated in various ways and provided for merchandising in a decoratively matched set of preferably 3 or 4 such vessels in a kit or box B.

The uniquely improved spout is also contemplated for use with non-handled drinking vessels, or in otherwords with vessels of the more ordinary drinking glass type. Examples of these are shown in FIGS. 15 and 16. In FIG. 15, the vessel is generally designated V4 which may comprise a conventionally tapered cylindrical body 40, and a spout 50. Spout 50 may be generally of the type already described in the previous embodiments, and more especially like that of the spout S5 of FIGS. 11 and 12. As a further variation, spout 50 is provided with ribs 52 similar to ribs 26' in FIGS. 11, 12 except that ribs 52 may extend slightly inwardly beyond the juncture of the spout floor with the peripheral side wall of the vessel, as at 54. It is further contemplated that the rearward portions 54 of the ribs 52 may project downwardly inside the peripheral side wall of the vessel for either part or all of the height of the vessel's body. These rearward portions 54 may also taper down to nothing in termination toward the bottom of the vessel. Utilization of such ribs 52, 54 will further provide improved channeling and spill-resistant features to the vessels, especially when relatively small amounts of liquid are being dispensed.

The vessel V5 shown in FIG. 16 merely is representative of a modified version of that shown in FIG. 15. Vessel V5 is shown with a body 60 which is of generally rectangular configuration when seen in horizontal plan and/or cross-sectional views. The spout 62 is generally of the type shown in conjunction with vessel V3 in FIG. 9, and need not be redescribed. Suffice it to say that in the vessels of FIG. 9 and of FIGS. 15 and 16, the troughed spouts may have their respective side walls also curved or angled inwardly toward their upper terminal edges, as already disclosed in the first-described embodiment, or the like.

It is apparent from the foregoing detailed description, that the stated objectives of the invention have been and are achieved by the evolved improvements described and illustrated. While detailed examples of several representative highly convenient and more efficient embodiments have made, the invention is not necessarily limited thereby, and reference should be made to the appended claims for a definition of scope of the several inventive features hereof.

What is claimed is:

1. In a liquid drinking vessel of the type adaptable for use by and while a user is in a partially or essentially fully reclining position, wherein the vessel includes a body of generally hollow form about a center vertical axis, with a closed bottom end, generally uninterrupted peripheral side wall terminating in an open upper end, with a liquid-directing generally open troughed spout portion integrally formed with and projecting generally laterally outwardly away from the axis and body at its open upper end to terminate in a mouth/lip-engageable terminal edge, the improvement wherein said spout's-mouth/lip-engageable terminal edge includes an upstanding outer wall portion, said outer wall portion having a width and a concave configuration for complemental mating with a user's lips, said open troughed spout portion comprising an upwardly facing bottom surface extending radially and laterally from said open end, said bottom surface being substantially planar from said open end of the vessel to said outer wall portion at central, and radial and lateral end locations of said bottom surface, said concave configuration being concave inwardly toward said central vertical axis, said upstanding outer wall portion and said bottom surface facilitating improved spill resistance.

2. An improved vessel as defined in claim 1, wherein the upstanding outer wall of the mouth/lip-engageable edge is of slightly concave configuration in both vertical and transverse horizontal cross sections thereof.

3. The vessel as defined in claim 1, wherein the open troughed spout portion additionally includes oppositely spaced side walls upstanding from the bottom surface and wherein said upstanding short outer wall portion of concave configuration has opposite ends which respectively smoothly curve to integrally and complementally blend with corresponding forward portions of the upstanding side walls of said troughed.

4. The vessel as defined in claim 3, wherein said trough's upstanding side walls converge toward the said mouth/lip-engageable terminal edge portion.

5. The vessel as defined in claim 3, wherein the open troughed spout portion further includes a plurality of spaced rib members upstanding from the bottom surface of said trough to further facilitate spill-resistant flow and channeling of the liquid when the vessel is in use.

6. The vessel as defined in claim 4, wherein said rib members are of less height than both the concaved shaped outer wall portion and the upstanding side walls which form part of said spout.

7. The vessel as defined in claim 3 or 5, wherein said upstanding side walls which form part of said spout curve inwardly toward each other at generally uppermost portions thereof to further impart improved spill-resistant character to the vessel.

8. The vessel as defined in claim 5, wherein said upstanding rib members of the bottom surface of said trough include at least one spaced-apart pair of rib members which converge toward said mouth/lip-engageable terminal edge portion.

9. The vessel as defined in claim 5 or 8, wherein said rib members integrally blend with and connect with said concave shaped outer wall portion at their respective forward ends most remote from said center axis, and said rib members at their respective opposite rearward ends taper and blend into smooth transitional non-rib formation at a rearward floor portion of said trough where it intersects with the hollow body of the vessel.

10. The vessel as defined in claim 9, wherein said rib member integrally blend with and connect with said concave shaped outer wall portion at their respective forward ends most remote from said center axis, and said rib members at their respective opposite rearward ends fully extend at least to the point where said rearward floor portion of said trough intersects with the hollow body of the vessel.

11. The vessel as defined in claim 1, wherein said vessel body is of a cup-like form and includes a handle joined unitarily and spaced circumferentially from said spout.

12. The vessel as defined in claim 11, wherein said handle and spout are disposed on said body at generally 180° diametrically opposite positions.

13. The vessel as defined in claim 11, wherein said handle and spout are disposed on said body at generally 90° circumferentially spaced relation to each other in both right and left hand dispositional relationships.

14. A plurality of handled vessels of the type defined in claim 10, of which each of at least three different vessels includes the respective handles disposed in 90°, 180°, and 270° position relative to the spouts thereof, and a receptacle for said plurality of vessels to facilitate merchandising the plurality as a unitary package.

15. A packaged plurality of vessels as defined in claim 14, further including a conventional cup-style vessel not having a specialized drink-directing spout.

* * * * *